US007261491B2

(12) United States Patent
Rahn et al.

(10) Patent No.: US 7,261,491 B2
(45) Date of Patent: Aug. 28, 2007

(54) EDGER ASSEMBLY FOR A PAVING VEHICLE

(75) Inventors: Christopher W. Rahn, Virden, IL (US); Michael S. Eppes, Carlisle, PA (US)

(73) Assignee: Blaw-Know Construction Equipment Corporation, Shippensberg, PA (US)

( * ) Notice: Subject to any disclaimer, the term of this patent is extended or adjusted under 35 U.S.C. 154(b) by 0 days.

(21) Appl. No.: 10/795,467

(22) Filed: Mar. 8, 2004

(65) Prior Publication Data

US 2005/0111914 A1 May 26, 2005

Related U.S. Application Data

(60) Provisional application No. 60/452,865, filed on Mar. 7, 2003.

(51) Int. Cl.
*E01C 19/22* (2006.01)

(52) U.S. Cl. ..... 404/104; 404/118

(58) Field of Classification Search ..... 404/92, 404/93, 100, 101, 104, 118–120
See application file for complete search history.

(56) References Cited

U.S. PATENT DOCUMENTS 3,614,916 A * 10/1971 Benson ..... 404/133.05
3,680,451 A * 8/1972 Birtchet ..... 404/104
4,379,653 A * 4/1983 Brown ..... 404/118
5,344,254 A * 9/1994 Sartain ..... 404/104
6,238,136 B1 * 5/2001 Sovik et al. ..... 404/87

OTHER PUBLICATIONS

Ingersoll-Rand Company, Operator's Manual With Service Schedule and Specifications for Blaw-Knox PF-5510/PF-5500 Paver/Finishers, Pub. No. PF-5510/5500-OPR-6-99-1000, pp. A1-A3 and A14, 1999, USA.
Ingersoll-Rand Company, Parts Catalog for Blaw-Knox UltiMat Screeds, Pub. No. UMS-P-10-01-750, pp. A46-A47, 2001, USA.

* cited by examiner

*Primary Examiner*—Gary S. Hartmann
(74) *Attorney, Agent, or Firm*—Michael Best & Friedrich, LLP

(57) ABSTRACT

An edger assembly is for a paving vehicle screed for forming a paving material mat upon a base surface. The edger assembly includes a support connectable with the screed and an edger member having a contact surface contactable with the base surface. An actuator has an upper end coupled with the edger member and a lower end coupled with the support, the upper end being displaceable with respect to the lower end to vertically displace the edger member relative to the base surface. The actuator preferably includes two threaded blocks coupled with the support and two rotatable rods each coupled with the edger member and engaged with one block. Rotation of the rods vertically displaces the rods with respect to the support to displace the edger member. Preferably, a biasing member is disposed about each rod and biases the edger member in a direction generally toward the base surface.

30 Claims, 10 Drawing Sheets

EDGER ASSEMBLY FOR A PAVING VEHICLE

This application claims priority to U.S. Provisional Application Ser. No. 60/452,865, filed Mar. 7, 2003, the entire contents of which are incorporated herein by reference.

BACKGROUND OF THE INVENTION

The present invention relates to paving vehicles, and more particularly to edger assemblies for screeds used with paving vehicles.

Edger assemblies for paving vehicles are generally known and basically function to confine the sides of a head of paving material deposited forwardly of a screed. Typically, the edger assemblies include a frame connected with a lateral end of the screed, an edger plate providing a barrier surface and one or more actuators movably connecting the edger plate to the frame. The actuators enable the edger plate to be vertically displaced with respect to the frame to adjust the position of the plate with respect to the base surface.

SUMMARY OF THE INVENTION

In one aspect, the present invention is an edger assembly for a screed of a paving vehicle used to form a mat of paving material upon a base surface. The edger assembly comprises a support connectable with the screed and an edger member having a contact surface contactable with the base surface. An actuator has an upper end coupled with the edger member and a lower end coupled with the support. The actuator upper end is displaceable with respect to the actuator lower end so as to vertically displace the edger member with respect to the base surface.

In another aspect, the present invention is an edger assembly for a paving vehicle screed. The edger assembly comprises a support connectable with the screed and an edger member having a contact surface contactable with the base surface. An actuator is configured to vertically displace the edger member with respect to the support. Further, a biasing member is disposed about a portion of the actuator and configured to bias the edger member in a direction generally toward the base surface.

In a further aspect, the present invention is an edger assembly for a paving vehicle screed. The edger assembly comprises a support connectable with the screed assembly and a block coupled with the support and having a threaded opening. An edger member has a contact surface disposeable against the base surface and a rotatable rod is coupled with the edger member and threadably engaged with the block threaded opening. As such, rotation of the rod vertically displaces the rod with respect to the support so as to vertically displace the edger member with respect to the base surface.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
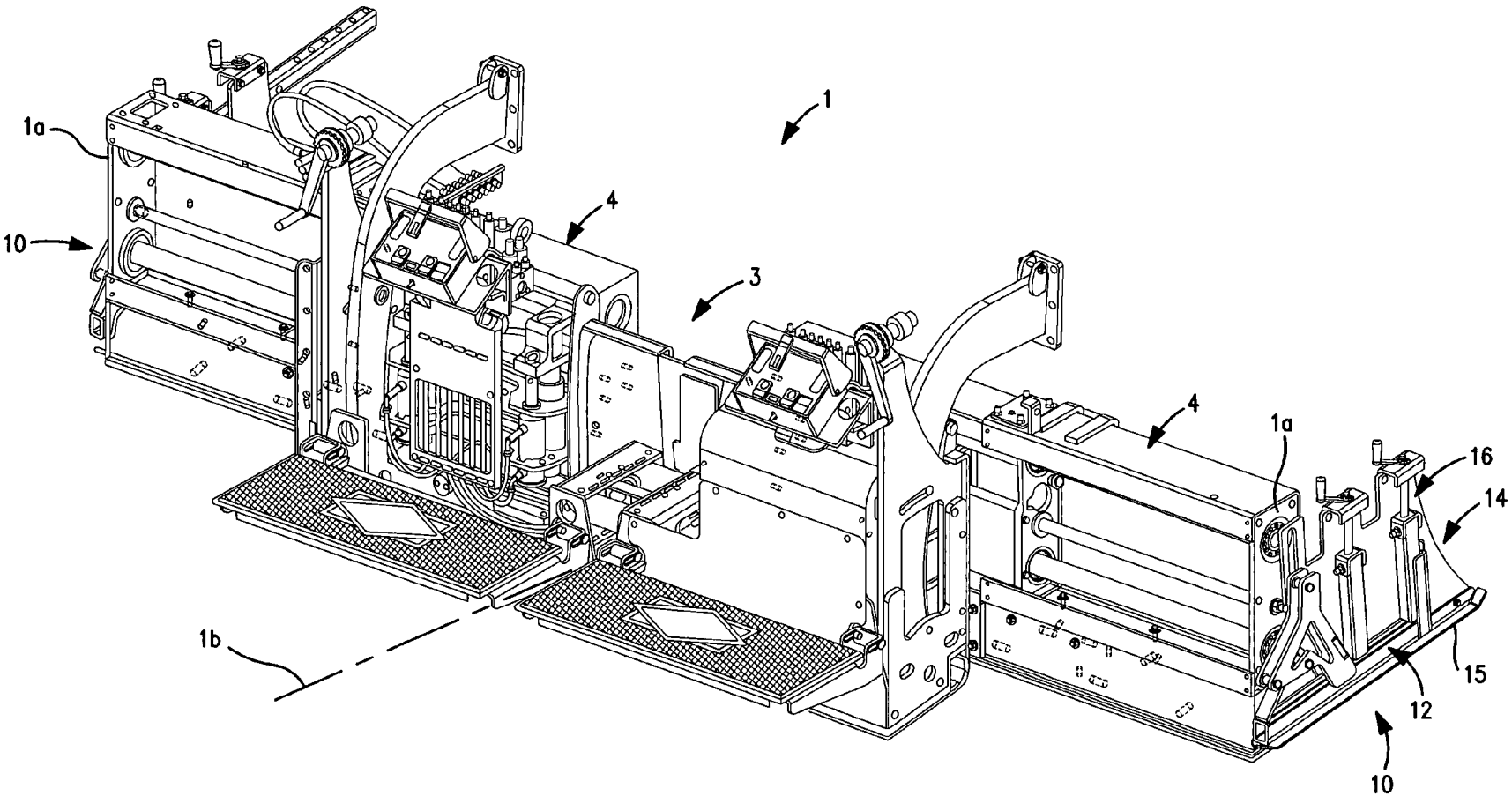
FIG. 1 is a perspective view of a screed including two edger assemblies in accordance with the present invention.

Certain terminology is used in the following description for convenience only and is not limiting. The words "right", left", "lower", "upper", "upward", "down" and "downward" designate directions in the drawings to which reference is made. The words "inner", "inwardly" and "outer", "outwardly" refer to directions toward and away from, respectively, a designated centerline 1*a* of a screed 1 or a geometric center of a component of the edger assembly 10 being described, the particular meaning being readily apparent from the context of the description. Further, as used herein, the word "connected" is intended to include both direct connections between two members without any other members interposed therebetween and indirect connections between members in which one or more other members are interposed therebetween. The terminology includes the words specifically mentioned above, derivatives thereof, and words or similar import.

Referring now to the drawings in detail, wherein like numbers are used to indicate like elements throughout, there is shown in FIGS. 1-11 a presently preferred embodiment of an edger assembly 10 for a screed 1 of a paving vehicle 2 used to form a mat of paving material M upon a base surface B. The edger assembly 10 comprises a support 12 connectable with the screed 1 and an edger member 14 having a contact surface 15 contactable with the base surface B. At least one and preferably two actuators 16 are each configured to vertically displace the edger member 14 with respect to the support 12. Preferably, the actuators 16 each have an upper end 16*a* coupled with the edger member 14 and a lower end 16*b* coupled with the support 12, the upper end 16*a* being displaceable with respect to the lower end 16*b* so as to vertically displace the edger member 14 with respect to the base surface B.

Figure 4:
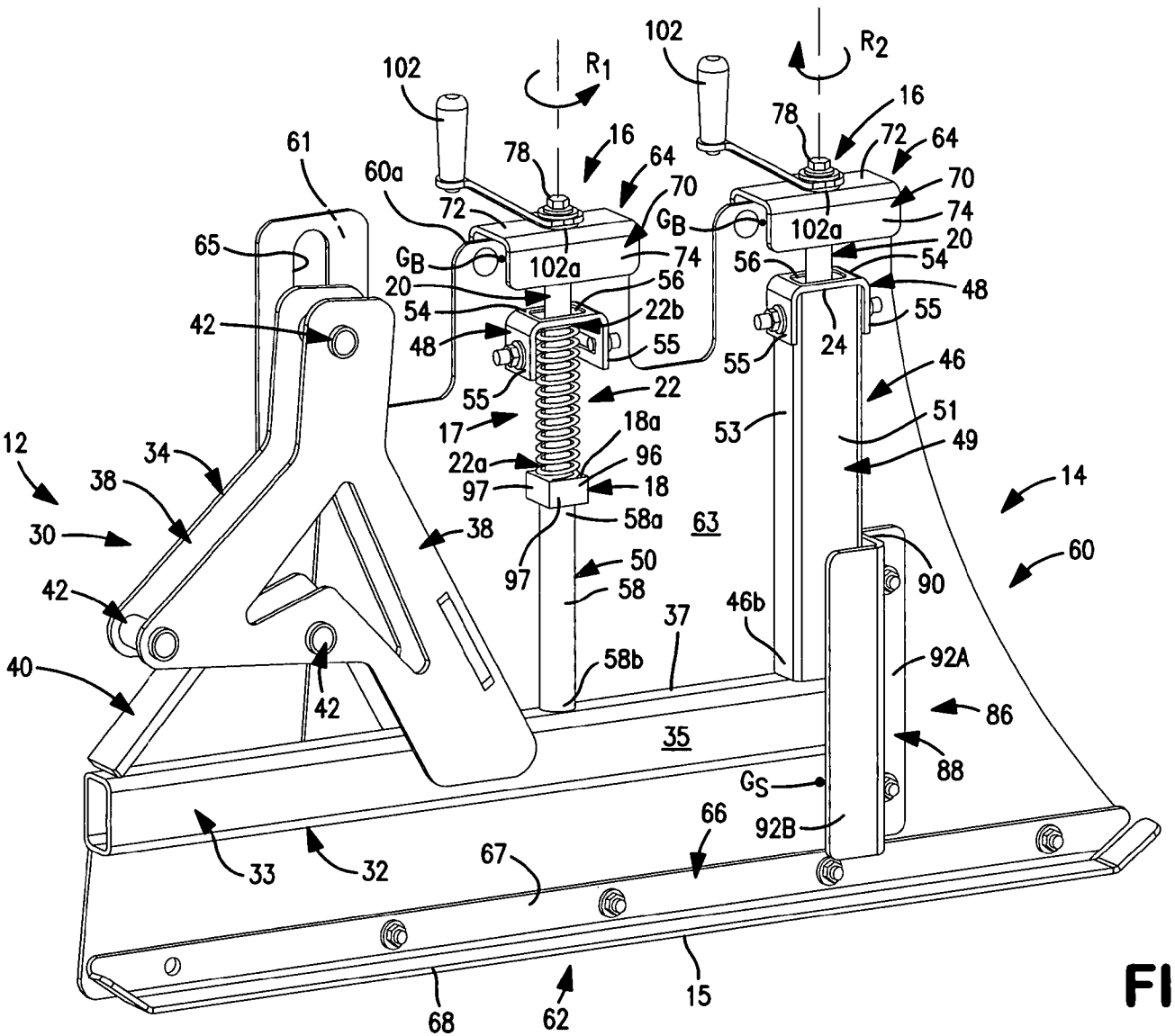
FIG. 4 is another view of the edger of FIG. 3, shown with the edger member in a lower position and with a retainer housing removed.
Figure 5:
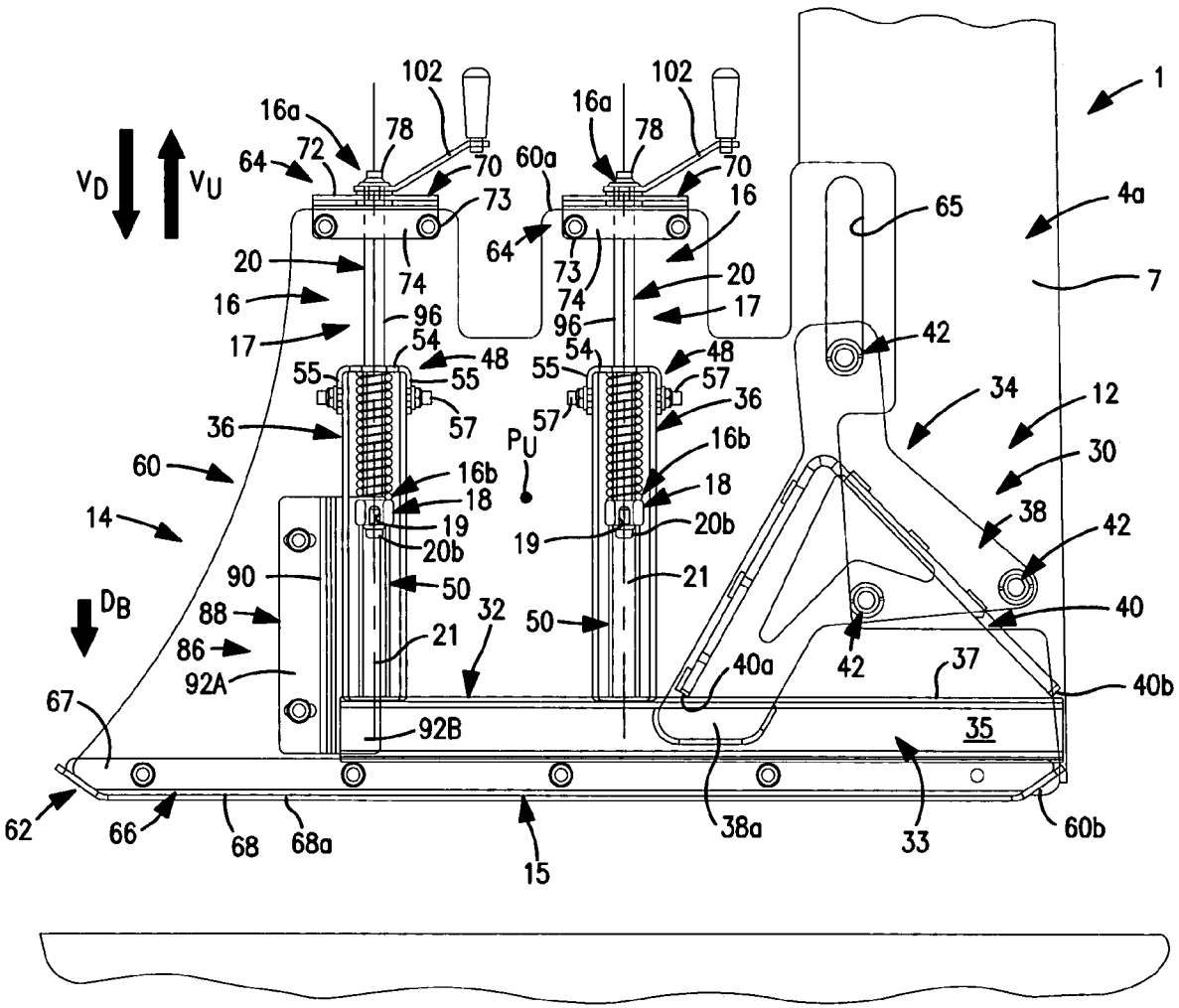
FIG. 5 is a side elevational view of a left edger assembly shown with the edger member in the upper position and with each of the retainer housing, an actuator block and a support tube in cross-section.
Figure 6:
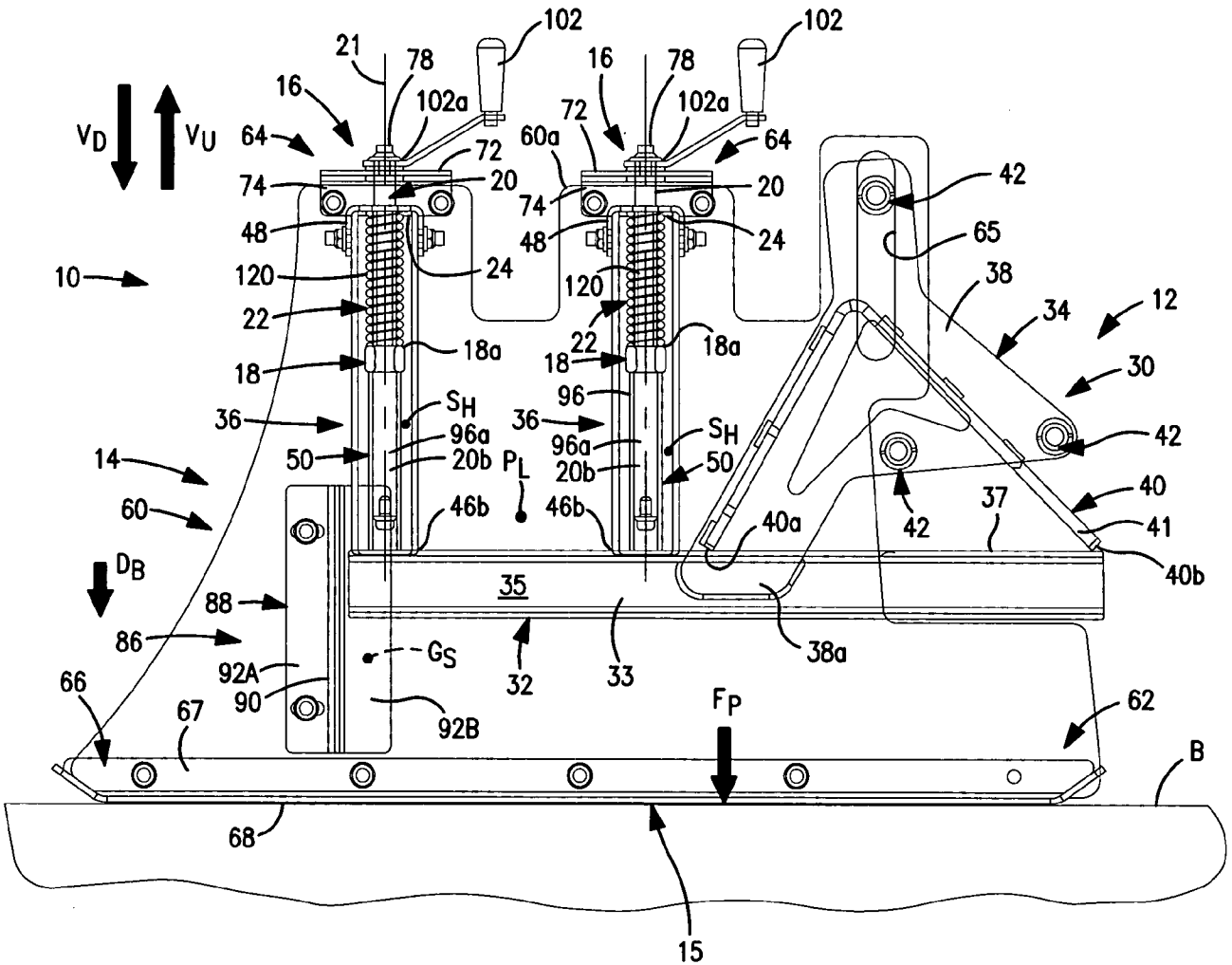
FIG. 6 is another view of the edger assembly of FIG. 5, shown with the edger member in the lower position.
Figure 7:
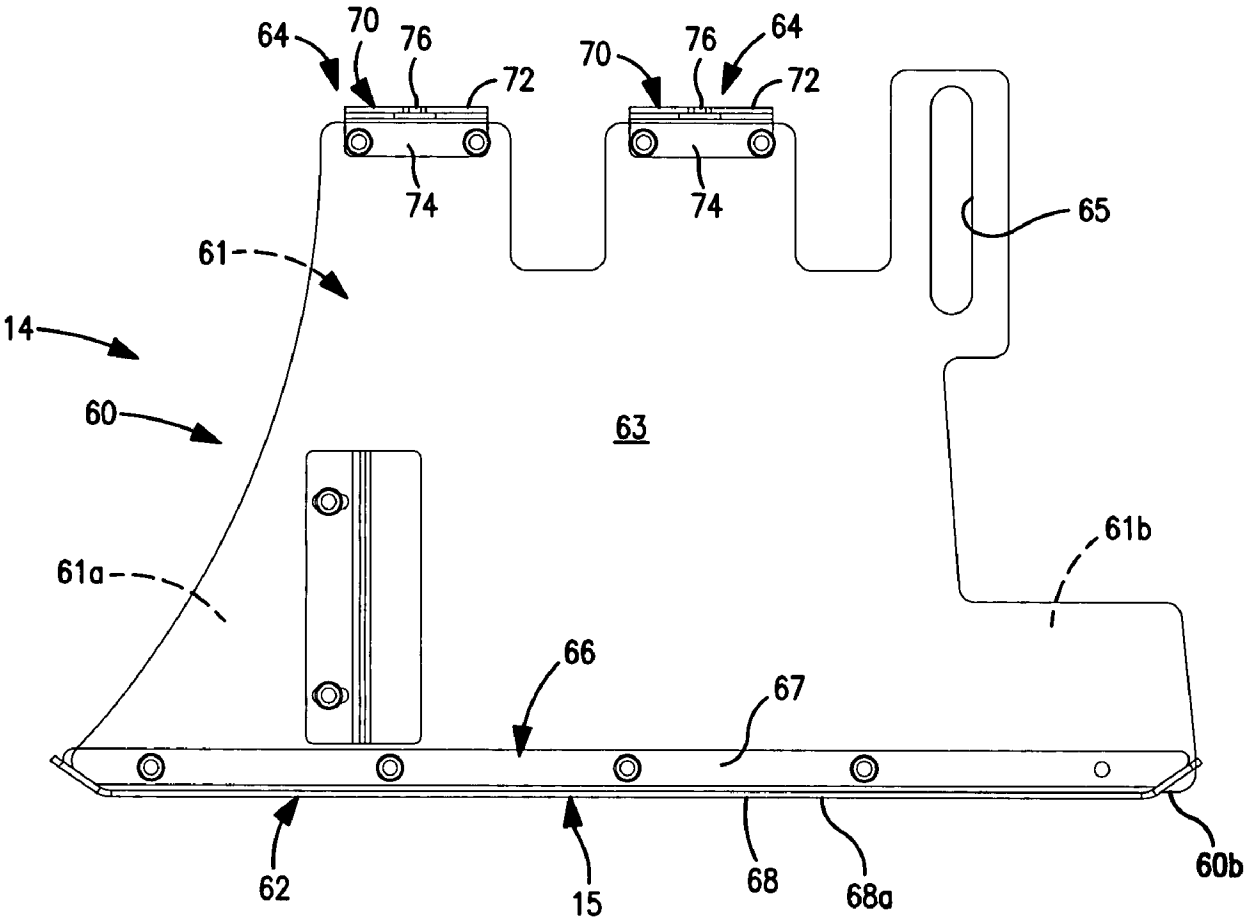
FIG. 7 is a side plan view of the edger member.
Figure 8:
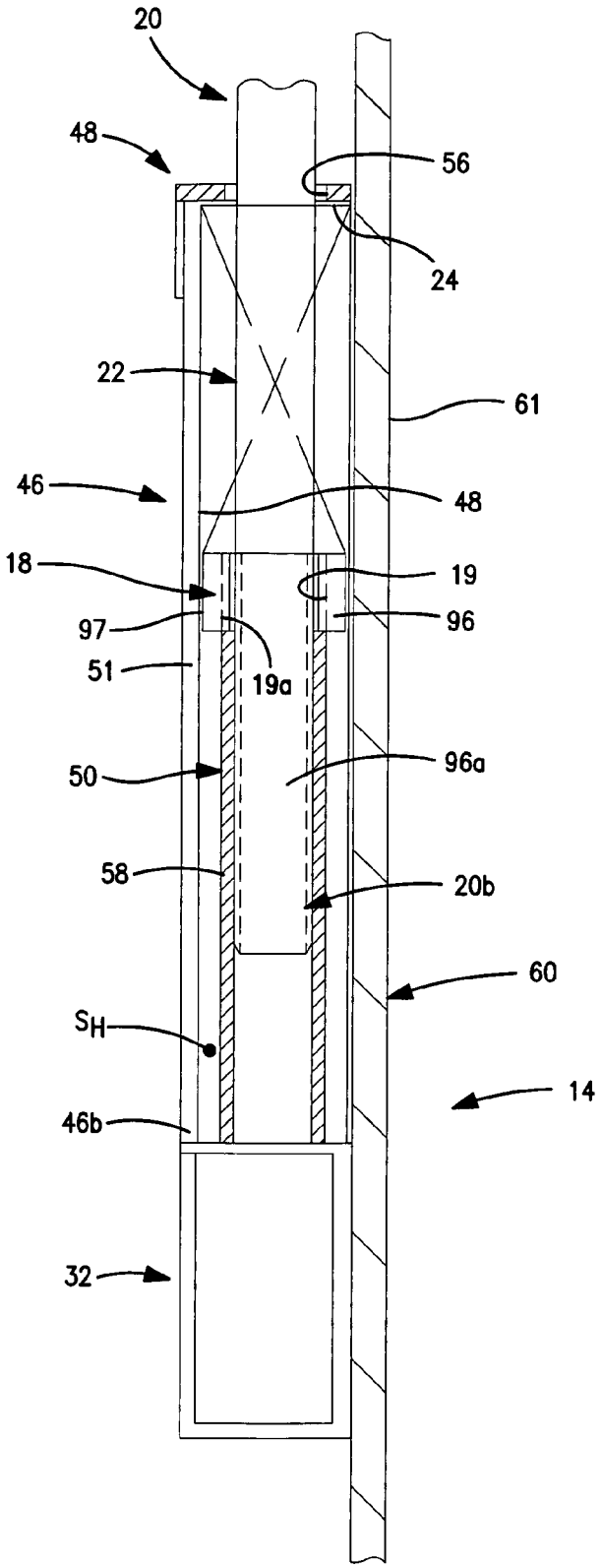
FIG. 8 is a broken-away, enlarged side cross-sectional view of the actuator housing and an actuator rod and block.

Most preferably, each actuator 16 is a jackscrew device 17 including a block 18 (e.g., a nut) coupled with the support 12 and having a threaded opening 19 and a rotatable rod 20 having a first end 20*a* coupled with the edger member 14 and a second end 20*b* threadably engaged with the block threaded opening 19. The rods 20 are each displaceable through the associated opening 19; specifically, rotation of the rod 20 vertically displaces the rod 20 with respect to the support 12 so as to vertically displace the edger member 14 with respect to the base surface B. More specifically, each rod 20 is rotatable in a first rotational direction $R_1$, preferably counterclockwise, so as to vertically displace the edger member 14 in a first, "downward" vertical direction $V_D$, such as from a first, uppermost position $P_U$ (e.g. FIGS. 3 and 5) and toward a second, lowermost position $P_L$ (FIGS. 4 and 6). It must be noted that the positions $P_U$, $P_L$ are indicated in FIGS. 5 and 6 by a central point "P" on the edger member 14 selected for convenience only and having no particular relevance other than as a convenient point of reference for purposes of discussion of the present invention. Further, each rod 20 is also rotatable in a second, opposing rotational direction $R_2$, preferably clockwise, so as to vertically displace the edger member 14 in an opposing second or "upward" vertical direction $V_U$, such as from the lowermost position $P_L$ and toward the uppermost position $P_U$.

Furthermore, the edger assembly 10 preferably also comprises at least one and most preferably two biasing members 22 each disposed about a portion of a separate one of the two preferred actuators 16 and each configured to bias the edger member 14 in a direction $D_B$ generally toward the base surface B. Each biasing member 22 has a first end 22*a* contactable with the actuator 16, preferably an upper surface 18*a* of the associated block 18, and a second end 22*b* contactable with the support 12, preferably a separate retainer surface 24 spaced vertically from the block 18. The biasing members 22 are each compressible, i.e., between the retainer surface 24 and the block surface 18*a*, so as to push against the actuator blocks 18 to bias the edger member 14 generally toward the base surface B. More specifically, each block 18 is preferably coupled to the support 12 by being disposeable against a generally horizontal surface section 26 of the support 12 and by having at least one generally flat outer surface section 18*b* disposed against a separate, generally flat vertical slide surface 28 (FIG. 8) of the support 12. As such, the blocks 18 are each vertically displaceable with respect to the support 12, but the slide surfaces 28 prevents rotation of the blocks 18, as discussed in further detail below.

Figure 10:
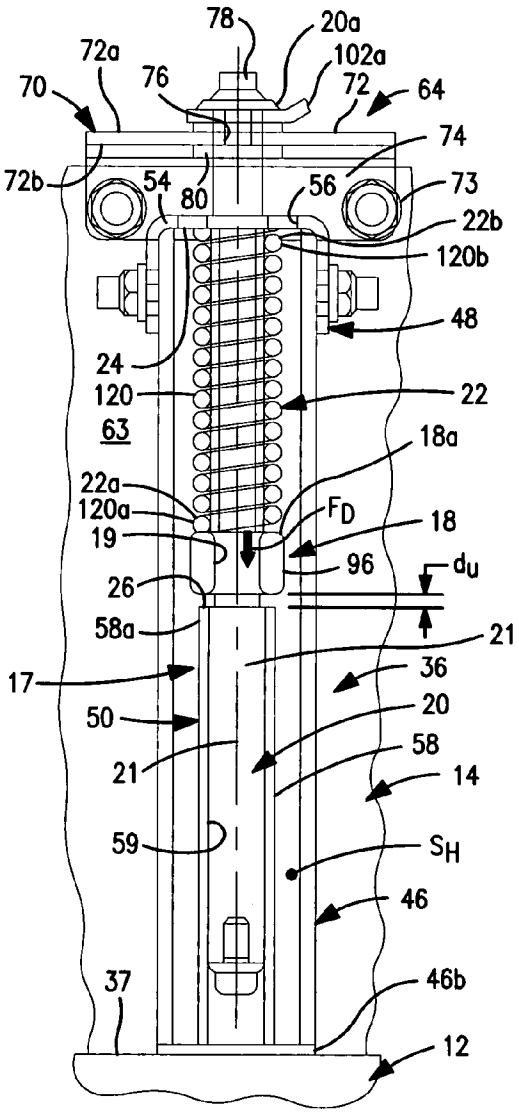
FIG. 10 is another view of the edger assembly section of FIG. 9, shown with an actuator block in a displaced position.
Figure 9:
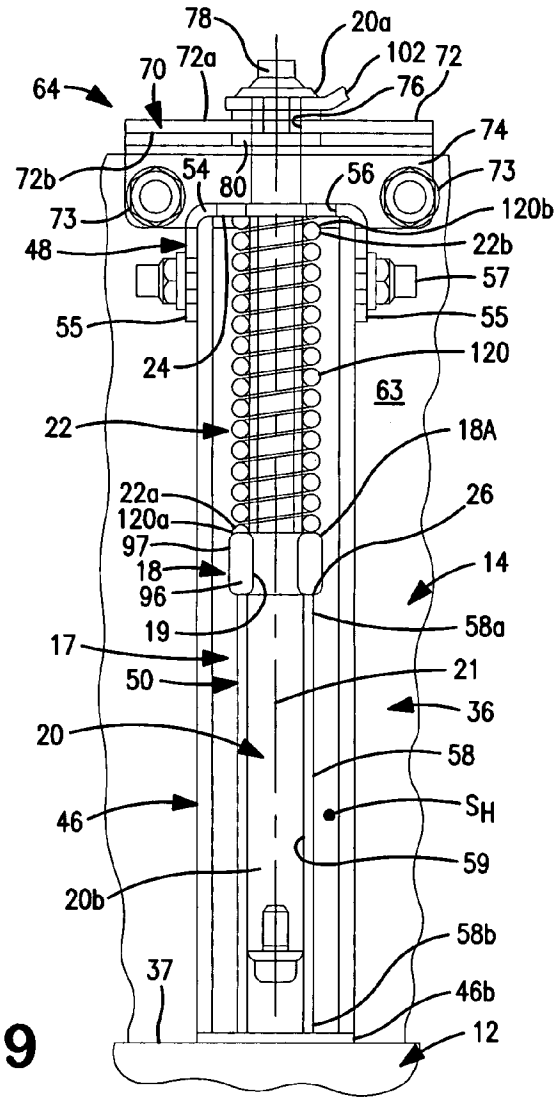
FIG. 9 is a broken-away, greatly enlarged side elevational view of an actuator, a biasing member and a support.

With this structure, when a rod 20 is rotated in the first direction $R_1$ while the edger contact surface 15 is disposed against the base surface B, the rod 20 is incapable of further displacement, such that the interaction between the rod and block threads thereafter causes the block 18 to vertically displace upwardly on the rod 20 and compresses the associated biasing member 22, as shown in FIG. 10. The biasing member 22 then exerts a downwardly directed force $F_D$ on the block 18 such that both the connected rod 20 (i.e., by threaded engagement with the block 18) and coupled edger member 14 are both biased downwardly toward the base surface B. Such downward biasing of the edger member 14 causes the edger member contact surface 15 to push against the base surface B with a "pre-load" force $F_P$ to maintain contact with the base surface B during paving operations, as discussed in further detail below. Having discussed the basic components of the present edger assembly 10, and certain preferred structures thereof, these and additional components are described in detail below.

Figure 2:
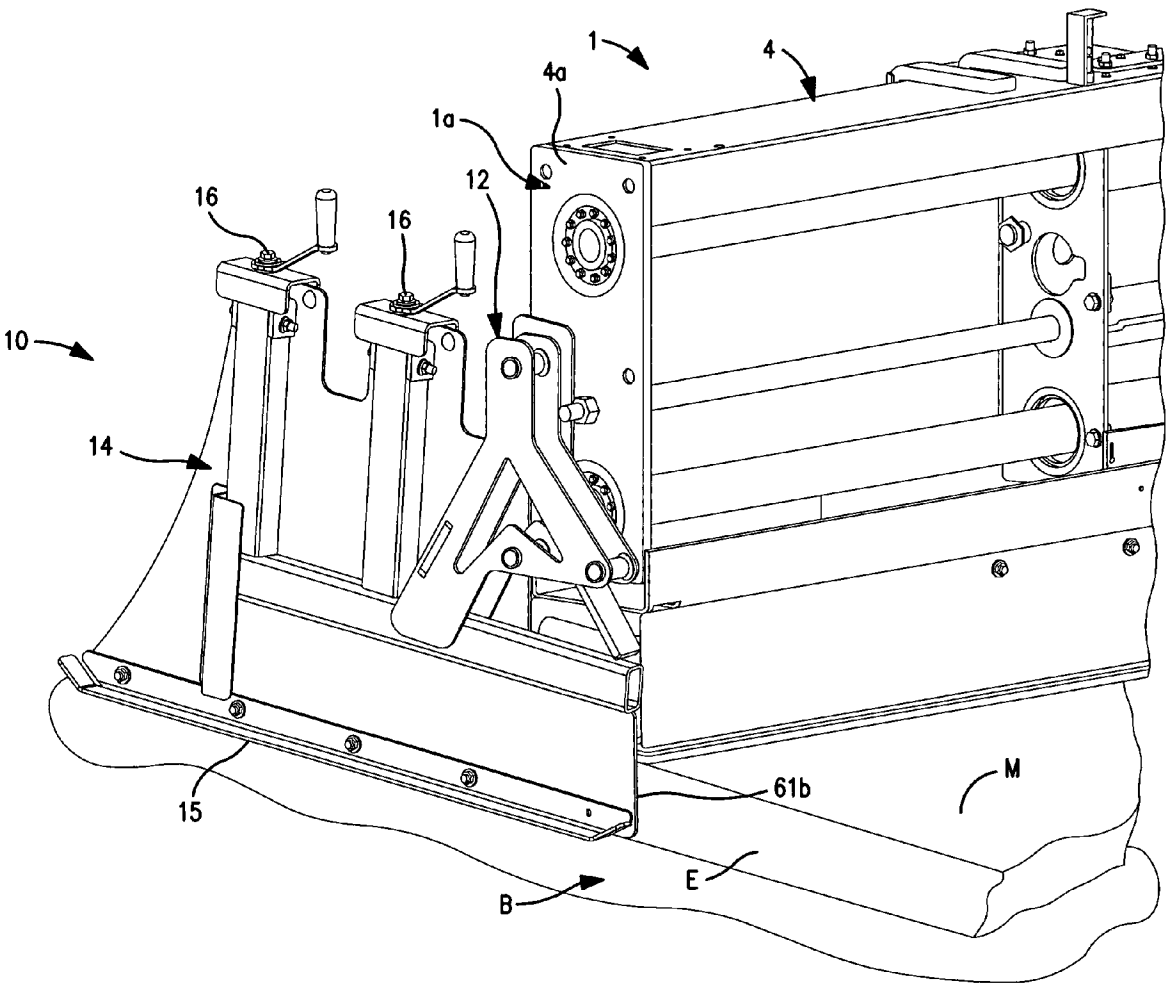
FIG. 2 is a perspective view of the left side portion of the screed with a left edger assembly mounted thereon.
Figure 3:
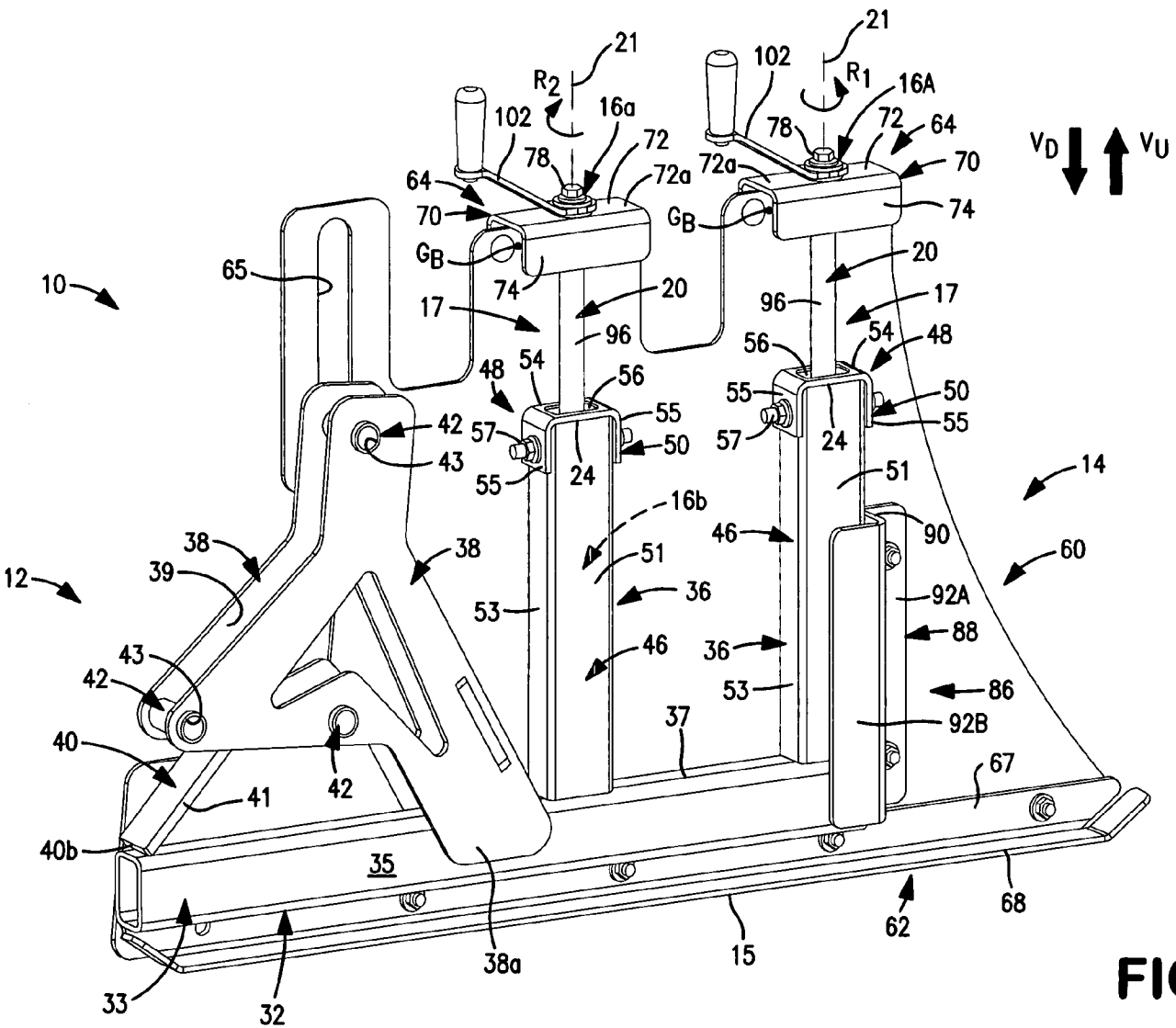
FIG. 3 is a side perspective view, taken from the rear, of a right edger assembly, shown with an edger member in an upper position.
Figure 11:
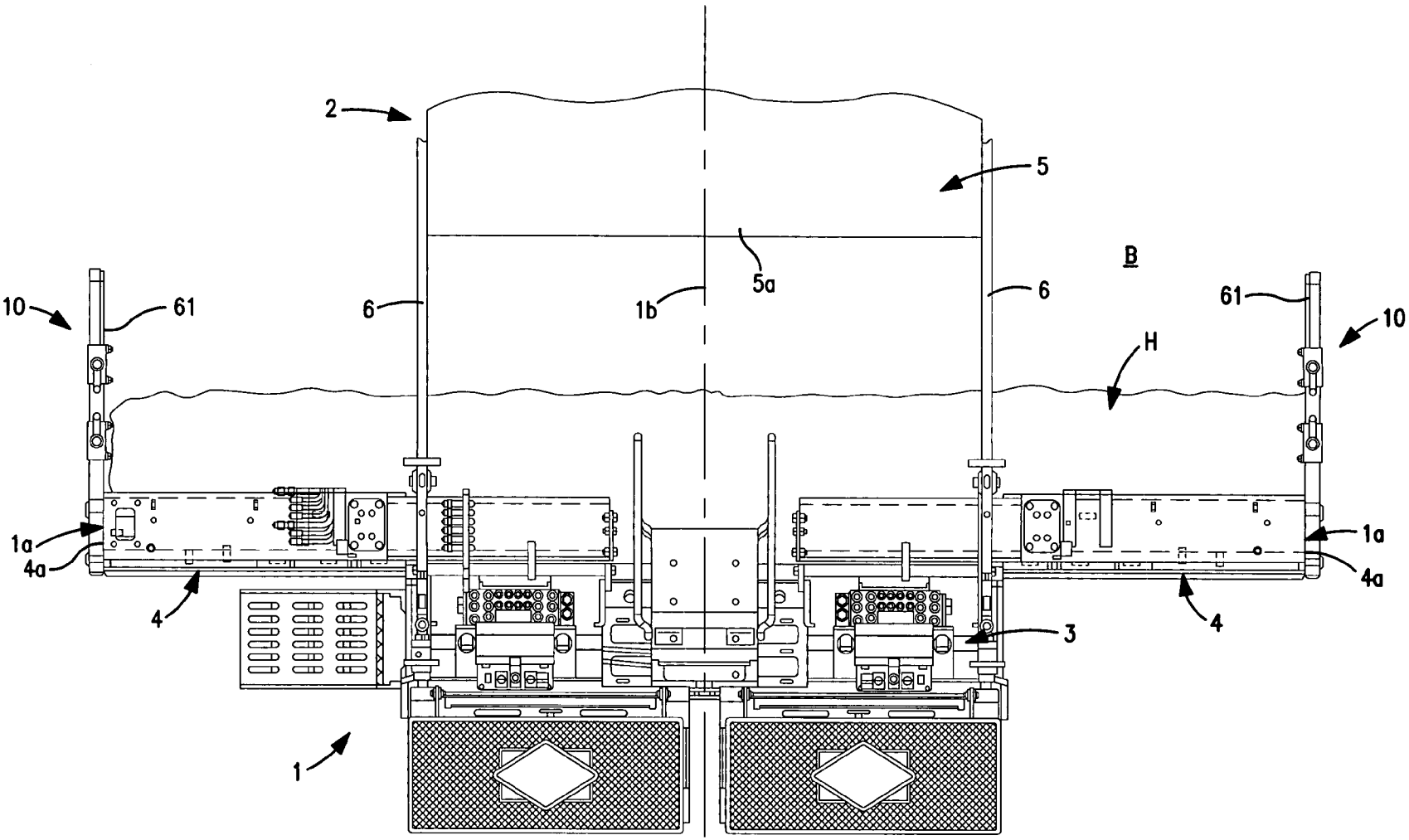
FIG. 11 is partly broken-away, top plan view of the screed and two edger assemblies, shown connected with a paving vehicle.

Referring first to FIGS. 1, 2 and 11, the edger assembly 10 of the present invention is preferably used as a pair of left and right edger assemblies 10 each mounted to a separate lateral end 1*a* of a screed 1. Preferably, the left and right edger assemblies 10 are substantially identically constructed, but oppositely oriented with respect to a longitudinal centerline 1*b* of the screed 1, such that the two edger assemblies 10 are generally mirror images of each other. As the two preferred edger assemblies 10 are generally identical, the present disclosure focuses on describing a single edger assembly 10 as the detailed description applies equally to either assembly 10.

The screed 1 may include both a main screed 3 and one or more extension screeds 4, as depicted in FIGS. 1 and 11, but may alternatively include only the main screed 3 (structure not shown). The screed 1 is connected to a tractor 5 of the paving vehicle 2 by means of a pair of tow arms 6 such that the screed 1 is towed from the rear end 5*a* of the tractor 5. As the paving vehicle 2 moves forwardly during a paving operation, paving material is directed off the rear end 5*a* of the vehicle 2 and deposits on the base surface B forwardly of the screed 1 so as to form a head of material H. The screed 1 is pulled into the head of material so as to level and compact portions of the material head H to form a mat of paving material M. The edger members 14 function to contain the lateral sides of the material head H forwardly of the screed 1; in other words, the edger member 14 prevents material from falling laterally outwardly beyond the screed ends 1*a*.

With a screed 1 that includes extension screeds 4, the edger assembly 10 is preferably connected with an outer lateral end 4*a* of the extension screed 4, most preferably to an outer vertical frame wall 7 of the extension screed 4. However, the edger assembly 10 may be connected with another portion of the extension screed 4, such as the front wall, top wall or rear wall (none indicated) or may be connected with another portion of the paving vehicle 2, such as for example, with the tractor 5 or one of the tow arms 6. Alternatively, with a screed 1 that comprises only a main screed 3, the edger assembly is preferably connected with the outer vertical frame wall (not indicated) of the main screed 3, but may be connected with any other portion of the main screed 3.

Referring now to FIGS. 2-6 and 8, the support 12 is preferably formed as a frame 30 that includes a generally horizontally extending main beam 32, a connective assembly 34 attached to the beam 32 and connectable with the screed 1 and a pair of retainer assemblies 36 attached to the main beam 32 and each disposed partially about a separate one of the two preferred actuators 16. The main beam 32 is preferably formed as a generally rectangular tube 33, but may be provided by any other appropriate beam or bar, such as a solid rectangular bar, a circular tube, an I-beam, a channel beam, etc. Preferably, the connective subframe 34 includes a pair of vertically-extending, generally triangular plates 38 and an angled reinforcing bar 40 disposed between the two triangular plates 38.

More specifically, the subframe triangular plates 38 are spaced-apart horizontally and are connected together by a plurality of connective bars or spools 42, preferably three, which extend horizontally between the two plates 38. The reinforcing bar 40 has opposing side edges 41 each disposed against the vertical inner surface 39 of a separate plate 38 and the bar 40 is attached to each plate 38 by appropriate means, such as interlocking tabs and notches, weldment material, etc. Further, each triangular plate 38 has a lower end 38*a* attached to an opposing vertical side surface 35 of the main beam 32 and the reinforcing bar 40 has opposing ends 40*a*, 40*b* attached to an upper horizontal surface 37 of the beam 32, so as to thereby rigidly connect the main beam 32 and the connective assembly 34. Furthermore, the connective spools 42 are each formed as a circular tube having a central bore 43 sized to receive a rod portion of a threaded fastener (e.g., a bolt). As such, a separate threaded fastener (none indicated) is inserted through each spool 42 and engages with a separate one of three threaded openings in an end wall 7 of the screed 1, so as to thereby fasten the support frame 30, and thus the entire edger assembly 10, to the screed 1.

Further, each retainer assembly 36 of the support 12 is configured to couple one of the preferred actuator blocks 18 to the support 12 and to least partially retain one of the preferred biasing members 22. The retainer assemblies 36 each include an elongated housing 46 having a generally hollow interior space $S_H$, a retainer cap 48 disposed about an upper end 46*a* of the housing 46 and a block support 50 disposed within the housing 46 and configured to support the block 18 of the associated actuator 16. Each housing 46 has a lower end 46*b* attached to the main beam 32 by appropriate means, such as weldment material, and extends generally vertically upwardly from the beam upper surface 37, the two housings 46 being spaced apart horizontally along the upper surface 37. The housings 46 are each preferably formed as a channel beam or C-shaped plate 49 having a central portion 51 with an inner vertical surface providing the slide surface 48 (FIG. 8) and two sidewall portions 53 each having a vertical edge (not indicated) disposeable against an outer surface 63 of the edger member 14, as described below. Further, the retainer caps 48 are each preferably formed as a generally C-shaped plate 52 having a central portion 54 and two leg portions 55. Each central portion 54 has a through hole 56 sized to enable the actuator rod 20 to extend through the retainer cap 48 and a lower horizontal surface surrounding the hole 56 and providing one retainer surface section 24, as described above. The two leg portions 55 of each cap 48 extend vertically downwardly from opposing sides of the central portion 54 and are each attachable to a separate one of the sidewall portions 53 of the associated housing 46, preferably by means of a threaded fastener 57, so as to secure the cap 48 to the housing 46.

Furthermore, the block supports 50 are each preferably formed as a generally circular tube 58 disposed within the housing interior space $S_H$ and extending vertically upwardly from the main beam 32. Each tube 58 has a lower end 58*b* attached to the beam upper surface 37 and an upper end 58*a* providing the horizontal support surface section 26, as described above, and a central bore 59 extending between the ends 58*a*, 58*b*. Thus, the support surface 26 is generally annular and surrounds an opening 59*a* into the bore 59, the opening 59*a* being generally aligned with the threaded opening 19 of the preferred actuator block 18. As such, a portion of the second, lower end 20*b* of the rod 20 is displaceable within the tube bore 59 when the rod 20 is rotated within the actuator block 18 as discussed above and in further detail below.

Although preferably formed as described above, it is within the scope of the present invention to construct the support 12 in any other appropriate manner. For example, the support frame 30 may be formed of a truss frame, a box frame or another appropriate frame having bars and/or plates that are connectable with the screed 1, support the actuators and provide the retainer and support surfaces 24, 26, respectively. Further for example, the retainer assembly/assemblies 36 of the support 12 may formed of one or more block support(s) 50 and a single horizontally-extending beam connected with the support 12 and having one or more holes, through which the rod(s) 20 extend, and a lower retainer surface against which the biasing member second end 22*b* is contactable (not shown). As yet another example, the block supports 50 may be provided by a horizontal surface section of the support main beam 32 and a through-hole extending through the surface section, such that one actuator block 18 rests upon each surface section and the rod second end 20*b* is disposeable within the associated opening (structure not shown). Furthermore, the edger assembly 10 may be constructed without any retainer assemblies 36 if the biasing members 22 and/or the actuator blocks 18 are omitted, such as for example, if the actuator(s) 16 are provided by fluid-operated cylinder actuators (as discussed below) or if the rod second, lower end 20*b* was engaged with a threaded opening in the support main beam 32. The scope of the present invention encompasses these and all other alternative structures of the support 12 that enable the edger assembly 10 to function generally as described herein.

Referring to FIGS. 2-7, the edger member 14 preferably includes a generally flat main plate 60, a rail 62 attached to a lower end 60*b* of the main plate 60 and providing the contact surface 15 and a pair of bearing members 64 each connected to the upper end 60*a* of the plate 60. The main plate 60 has a inner, vertically-extending surface 61 that provide a front, containment or "barrier" surface section 61*a* configured to contain or retain the lateral ends of a head of paving material (not shown) and a rear edge forming surface section 61*b* configured to form one side edge of a mat of material (not shown). The main plate 60 also has an outer vertically-extending surface 63 disposeable against various sections of the support 12, as discussed above and in further detail below. Further, the main plate 60 also has a vertically-extending slotted opening or slot 65 through which extends one of the connective spools 42 of the support 12, as described above, to connect the plate 60 with the screed 1. Specifically, a portion of the edger plate 60 is loosely "sandwiched" between the support connective subframe 34 and the proximal end wall 6 of the screed 1 so as to thereby movably connect the edger member 14 to the screed 1. Furthermore, the edger rail 62 is preferably formed as an elongated, angled plate 66 having an vertical portion 67 attached to the lower end 60*b* of the edger plate 60, preferably by means of a plurality of threaded fasteners (not indicated), and a generally horizontal portion 68 having a lower surface 68*a* that provides the edger contact surface 15.

Preferably, each bearing member 64 is formed as a channel beam or plate 70 having a central horizontal portion 72 and opposing leg portions 74 extending vertically from the central section 72, the plate 70 straddling the upper end 60*a* of the edger main plate 60. More specifically, the inner leg portion 72 of each bearing plate 70 is attached to the edger plate inner surface 61, preferably by a pair of threaded fasteners 73, and the central portion 72 extends horizontally outwardly from the plate outer surface 63, such that a gap $G_B$ is formed between the outer leg section 74 and the main plate outer surface 63. Further, the central portion 72 of each plate 70 includes a clearance opening 76 sized to receive a section of the rod upper end 20*a* so as to couple the associated actuator 16 to the edger 14. More specifically, the rod 20 extends upwardly from the actuator block 18, through the gap $G_B$ and the central opening 76, and a threaded fastener 78 (e.g., a bolt 78) is then engaged with a threaded opening (not indicated) into the upper rod end 20*a*. The fastener 78 has a head (not indicated) supported upon the upper surface 72*a* of the bearing plate central portion 72 and a retainer ring 80 is inserted about a section of the rod 20 so as to be disposed generally against the lower surface 72*b* of the plate central portion 72, As such, a section of the bearing plate 70 is sandwiched between the head of the fastener 78 and the ring 80. With this structure, the actuator rod 20 is restrained from displacing vertically with respect to the bearing member 64, but is rotatable within the bearing opening 76, as discussed in further detail below.

Further, the edger 14 preferably further includes a guide 86 attached the main plate 60 and configured to slidably couple the edger 14 with the support 12. Preferably, the guide 86 is formed as a stepped plate or zee ("Z") beam 88 having a central portion 90 and two generally parallel leg portions 92A, 92B extending perpendicularly from opposing longitudinal edges of the central portion 90 in opposing directions. An inner leg section 92A is disposed against and attached to the edger main plate 60, preferably by threaded fasteners (not indicated), such that a slide gap $G_S$ is formed between the plate outer surface 63 and the outer leg portion 92B. A portion of the front retainer assembly 36 and an end portion of the support main beam 32 are each disposed within the slide gap $G_S$. As such, when the actuators 16 displace the edger 14 with respect to the support 12, the guide 86 slides over the portions of the retainer housing 46 and the beam 32 as the edger plate outer surface 63 slides against the inner vertical edges (not indicated) of the two retainer housings 46 and the inner vertical side surface 35 of the support main beam 32. Thus, the guide 86 enables the edger member 14 to be slidably displaceable in vertical directions with respect to the support 12, but prevents the edger member 14 from moving or deflecting laterally with respect to the support 12, particularly inwardly toward the screed centerline 1*b*.

Although the edger member 14 is preferably constructed as described above, it is within the scope of the present invention to construct the edger member 14 in any other appropriate manner. For example, the edger plate 60 may be constructed with any appropriate shape, may be formed without the connective slot 65, such that the edger member 14 is only connected with the screed 1 through the actuator (s) 16 and the support 12, and/or may be constructed without the guide 86, so as to be connected to the support 12 only through the actuator(s) 16. Further for example, the edger member 14 may be formed as two or more plates connected by appropriate means (not shown) or as a frame and a plurality of panels or blocks attached to the frame and configured to provide the barrier surface section 61*a* and the edge forming surface section 61*b* (structure not shown). The present invention embraces these and all other constructions of the edger member 14 that enables the edger assembly 10 to function generally as described herein.

Referring to FIGS. 2-6, 9 and 10, as discussed in detail above, the two preferred actuators 16 are preferably constructed as "jackscrew" devices 17 that include the rotatable rod 20 coupled with the edger member 14 and the block 18 with the threaded opening 19 engaged by an end 20*b* of the rod 20. The rod 20 has a central axis 21 and is preferably formed as an elongated circular bar 96 having a lower externally threaded portion 96*a* engageable with the interior threads of the block opening 19 and an upper internally threaded opening (not indicated) engageable with the threaded fastener 78. However, the actuator bar 96 may alternatively be threaded along its entire length of the rod 20 (or any lesser section(s) thereof) and/or have an externally threaded upper portion engageable by a nut (neither shown). Preferably, the actuator block 18 is formed as a generally square or rectangular nut 96 having four vertical side surfaces 97, one of the surfaces 97 being positioned in contact with the retainer slide surface 48 as described above. However, the actuator block 18 may be formed in any other appropriate manner, such as for example, as an elongated cylinder or tube of any appropriate shape (circular, rectangular, hexagonal, etc.) and having one or more generally flat surfaces contactable with the retainer slide surface as discussed above. Further, although the block 18 is preferably "freely" disposed on the support surface 26 on the upper end of the support tube 58, the block 18 may be movably connected with the support 12 by appropriate means, such as for example, one or more vertical guide rods each extending through a separate vertical passage in the block 18 such that the block 18 is slidable upon the guide rods (structure not shown).

As discussed above, the edger assembly 10 preferably has two actuators 16, such that a first threaded rod 20 is engaged with a first actuator block 18 and a second threaded rod is engaged with a second actuator block 18, the two block and rod assemblies 18/20 being spaced apart horizontally on the support 12. As such, each rod 20 may be vertically displaced independently of the other rod 20, so that relative displacement one rod 20 with respect to the other rod 20 causes the edger member 14 to rotate or tilt within a vertical plane (not indicated) extending through the edger plate 60. Further, when one rod 20 is vertically displaced relative to the other rod 20 when the edger contact surface 15 is disposed against the base surface B, the edger member 14 may be caused to "bear down" on the base surface B with a greater pre-load force at either the front end or the rear end of the edger member 14.

With the preferred actuator structure, the rod second, lower end 20*b* is threadably engaged with the actuator block 18 and is extendable into the associated block support tube 58 so as to be vertically displaceable with respect to the tube 58, the block 18 and the support 12. When the rod 20 is rotated, preferably by means of the handle 102 (described below), the rod lower threaded portion 96*a* interacts with the block threads 19*a* such that the rod portion 96*a* advances into or withdraws from the actuator block 18 and thereby displaces the rod 20 in vertical directions along the rod axis 21. As the one or more rods 20 displaces along the axis 21, the edger member 14 is lowered or lifted by the rod(s) 20 so as to displace a distance toward or away from the base surface B equal to the displacement of the rod 20 relative to the support 12.

Alternatively, the edger assembly 10 may be alternatively constructed without an actuator block 18 and with a support 12 that includes one or two (or more) threaded openings (not shown) With this structure, the second end 20*b* of each actuator rod 20 is threadably engaged with one support opening (not shown), such that rotation of the rod 20 vertically displaces the rod 20 (i.e., along the axis 21) with respect to the support 12 so as to vertically displace the edger member 14 with respect to the base surface B.

Preferably, the edger assembly 10 further comprises a crank or handle 102 attached to the first, upper end 20*a* of the rod 20 and configured to manually rotate the rod 20 in opposing rotational directions $R_1$, $R_2$. Preferably, the rod 20 extends through an opening (not indicated) in an inner portion 102*a* of the handle 102 and the handle portion 102*a* is sandwiched between a pair of washers 104, such that the handle 102 and washers 104 are retained between the plate upper surface 72*a* and the nut 78. Alternatively, the edger assembly 10 may further comprise one or more motors (none shown) operably connected with the actuator rods 20 and configured to rotate the rods 20 in the opposing rotational directions $R_1$, $R_2$. Each motor may be mounted at any appropriate location on the edger assembly 10 or on the screed 1, such as for example, a separate motor being mounted on the end of the each rod 20 (as shown) or one or more motors mounted on the support main beam 32 (or on the screed 1) and driving the rods 20 through a chain, belt, gears or other transmission components (not shown). With an edger assembly 10 provided with motor(s), the assembly 10 preferably further comprises a controller (not shown) disposed on the screed 1 (or on the tractor 5) and configured to operate the motors (not shown), such that adjustment of the edger assembly 10 may be performed automatically and remotely by an operator located on the screed 1 or on the tractor 5.

As yet another alternative, the actuators 16 may be provided by one or more fluid-operated cylinder actuators or cylinders, such as hydraulic cylinders or pneumatic cylinders (none shown). Specifically, the fluid-operated cylinders may each include a cylinder body (not shown) connected with the support 12 and a piston rod (not shown) having a first end connected with the edger member 14 and a second end movably disposed within the cylinder body. As such, displacement of the rod with respect to the cylinder body displaces the edger member 14 with respect to the base surface B. With an edger assembly 10 that includes fluid-actuated cylinders, the edger assembly 10 preferably further comprises a control valve (not shown) operably connected with the cylinder and configured to control displacement of the rod and a controller (not shown) disposeable on the screed assembly 1 or on the tractor 5 and configured to operate the cylinder actuator(s), thereby enabling adjustment of the edger assembly 10 to be performed automatically and remotely by an operator located on the screed 1 or on the tractor 5.

Referring now to FIGS. 4-6, 9 and 10, the biasing members 22 are each preferably provided by a conventional compression coil spring 120 having a central opening or bore 122 through which a section of the rod 20 extends when the biasing members 22 are installed in the edger assembly 10. However, the biasing member 22 may be provided by another type of spring, such as a leaf spring (not shown) having one end contacting a section of the rod 20 and another end contacting the block 18. Further, the biasing member 22 may be provided by another type of compressible member, such as a circular tube of a polymeric material or a natural or synthetic rubber material. In addition, the edger assembly 10 may be constructed without any biasing member(s) 22, such as if the actuator 16 were a fluid-operated cylinder (not shown) configured to operate such that the piston rod is retractable by a certain distance The preferred compression coil spring 120 is assembled upon a section of the actuator rod 20, once the rod 20 is inserted through the retainer cap 48 through hole 56 and prior to engaging the actuator block 18, then the rod threaded portion 96 is inserted into the block opening 19. When so assembled, the first, lower end 120*a* of the spring 120 contacts the block upper surface 18*a* and the spring second, upper end 120*b* contacts the lower, retainer surface 54*a* of the retainer cap 48, such that the spring 120 extends generally vertically between the edger upper end 14*a* and the support 12. By being disposed about the rod 20, the actuator rod 20 prevents sideways bending/deflection or "buckling" of the biasing member 22 when the spring 120 compresses between the retainer cap 48 and the block 18.

Prior to performing a paving operation with the paving vehicle 2, the edger assembly 10 is mounted to the screed 1 by connecting the support connective assembly 34 to the screed end wall 7 (e.g., FIG. 5) as discussed above, such that the support 12 is connected to the screed 1 and the edger member 14 is retained between the connective assembly inner plate 38 and the end wall 7 by the spool 42 extending through the slot 65. Then, the edger member 14 is vertically displaced with respect to the support 12, preferably by manually rotating the preferred actuator rods 20 using the handles 102, until the edger contact surface 15 contacts the base surface B. Thereafter, the rods 20 are rotated further to establish a desired pre-load force exerted by the edger member 14 against the ground or base surface B. Specifically, the rod 20 of each actuator 16 is rotated to displace the block 18 upwardly (e.g., by a distance $d_U$) in the second vertical direction $V_U$, while the rod 20 remains generally at a specific vertical position along the axis 21, to compress (or deflect) the biasing member 22, as best shown in FIG. 10. The biasing member 22 thereby exerts a force $F_D$ downwardly against the block 18 (and upwardly against the retainer cap 48). Due to the fact that the block 18 is threadably engaged with the rod 20, which is connected to the edger member 14, the downward force $F_D$ on the block 18 causes the edger member 14 to be biased downwardly against the base surface B, thereby generating the pre-load force $F_P$ (FIG. 6) of the edger rail 62 against the base surface B. As the paving vehicle 2 travels during a paving operation, the edger rails 62 slide along the base surface B as the inner barrier surfaces 61 of the two preferred edger assemblies 10 retain the head of paving material H disposed along the front end of the screed 1. In addition, the edge forming surface sections 61*b* of the two assemblies 10 each form one side edge E (FIG. 2) of the material mat M being formed by the screed 1.

It will be appreciated by those skilled in the art that changes could be made to the embodiments or constructions described above without departing from the broad inventive concept thereof. It is understood, therefore, that this invention is not limited to the particular embodiments or constructions disclosed, but it is intended to cover modifications within the spirit and scope of the present invention as defined in the appended claims.

We claim:

1. An edger assembly for a screed of a paving vehicle used to form a mat of paving material upon a base surface, the edger assembly comprising:

a support substantially immovably connectable with the screed;

an edger member having upper and lower ends, the lower end having a contact surface contactable with the base surface; and an actuator having an upper end coupled with the edger member and a lower end coupled with the support such that the actuator extends generally vertically upwardly from the support toward the edger member upper end, the upper end being displaceable with respect to the lower end so as to vertically displace the edger member with respect to the base surface and with respect to the support.

2. The edger assembly as recited in claim 1 wherein the actuator includes:

a block coupled with the support and having a threaded opening; and a rotatable rod having a first end coupled with the edger member and a second end threadably engaged with the block opening such that the rod is displaceable through the opening and with respect to the support so as to vertically displace the edger member with respect to the base surface.

3. The edger assembly as recited in claim 2 wherein the rod is rotatable in a first rotational direction so as to vertically displace the edger member in a first vertical direction and rotatable in a second, opposing rotational direction so as to vertically displace the edger member in a second, opposing vertical direction.

4. The edger assembly as recited in claim 3 further comprising a handle attached to the rod first end and configured to manually rotate the rod in opposing rotational directions.

5. The edger assembly as recited in claim 3 further comprising a motor operably connected with the rod and configured to rotate the rod in opposing rotational directions.

6. The edger assembly as recited in claim 5 further comprising a controller disposeable on the screed and configured to operate the motor.

7. The edger assembly as recited in claim 1 wherein the support includes a threaded opening and the actuator includes a rotatable rod having a first end coupled with the edger member and a second end threadably engaged with the support opening such that rotation of the rod vertically displaces the rod with respect to the support so as to vertically displace the edger member with respect to the base surface.

8. The edger assembly as recited in claim 1 wherein the actuator includes a fluid-operated cylinder connected with the support and a rod having a first end coupled with the edger member and a second end movably disposed in the cylinder such that displacement of the rod with respect to cylinder displaces the edger member with respect to the base surface.

9. The edger assembly as recited in claim 8 further comprising a control valve operably connected with the cylinder and configured to control displacement of the rod and a controller disposeable on the screed assembly and configured to operate the cylinder.

10. The edger assembly as recited in claim 1 further comprising a biasing member configured to bias the edger member generally toward the base surface.

11. The edger assembly as recited in claim 1 wherein:

the actuator includes a rotatable rod coupled with the edger member and displaceably connected with the support such that rotation of the rod displaces the edger member vertically with respect to the base surface; and the edger assembly further comprises a biasing member disposed about the rod and configured to bias the edger member generally toward the base surface.

12. An edger assembly for a screed of a paving vehicle used to form a mat of paving material upon a base surface, the edger assembly comprising:

a support connectable with the screed;

an edger member having a contact surface contactable with the base surface;

an actuator configured to vertically displace the edger member with respect to the support; and a biasing member disposed about a portion of the actuator and configured to bias the edger member in a direction generally toward the base surface;

wherein the actuator has an end coupled with the support, the support includes a retainer surface spaced generally vertically above the actuator end, and the biasing member extends between the actuator end and the retainer surface.

13. The edger assembly as recited in claim 12 wherein the biasing member has a first end contactable with the support and a second end contactable with the actuator, the biasing member being compressible so as to push against the actuator to bias the edger member generally toward the base surface.

14. The edger assembly as recited in claim 12 wherein:

the actuator includes a block coupled with the support, the block having a threaded opening, and a rotatable rod threadably engaged with the block opening and coupled with the edger member such that rotation of the rod displaces the rod with respect to the support to vertically displace the edger member with respect to base surface; and the biasing member is disposed about the rod and is contactable with the block such that when the rod is rotated while the edger contact surface is disposed against the base surface, the biasing member compresses and pushes against the block so as to bias the edger member against the base surface.

15. The edger assembly as recited in claim 14 wherein the support includes a retainer surface spaced vertically from the block and the biasing member has a first end contactable with the block and a second end contactable with the retainer surface, the biasing member being compressible between the retainer surface and the block.

16. The edger assembly as recited in claim 14 wherein the support further has a generally flat vertical slide surface and the block has a generally flat outer surface section disposed against the slide surface such that the slide surface prevents rotation of the block and the block is vertically displaceable with respect to the support.

17. The edger assembly as recited in claim 16 wherein the support further has a generally horizontal surface section and an opening through the surface section, the block is disposeable against the support surface and the rod extends through the block and into the support surface opening.

18. The edger assembly as recited in claim 14 wherein the biasing member has a central opening and the rod extends completely through the central opening such that the rod prevents buckling of the biasing member when the member is compressed.

19. The edger assembly as recited in claim 12 wherein the edger member has an upper end and a lower end spaced vertically from the upper end, the edger member contact surface being provided on the member lower end, and the biasing member extends generally vertically between the edger upper end and the support.

20. The edger assembly as recited in claim 12 wherein the actuator is a first actuator, the biasing member is a first biasing member, and the edger assembly further comprises a second actuator spaced from the first actuator and configured to vertically displace the edger plate and second biasing member disposed at least partially about the second actuator and configured to bias the edger member in a direction generally toward the base surface.

21. An edger assembly for a screed of a paving vehicle used to form a mat of paving material upon a base surface, the edger assembly comprising:

a support substantially immovably connectable with the screed assembly;

a block coupled with the support and having a threaded opening, the block being vertically displaceable with respect to the support;

an edger member having a contact surface disposeable against the base surface;

a rotatable rod having an upper end coupled with the edger member and a lower end threadably engaged with the block threaded opening such that rotation of the rod vertically displaces the rod with respect to the support so as to vertically displace the edger member with respect to the base surface and with respect to the support; and a biasing member configured to bias the block in a generally downward direction toward the base surface so as to bias the edger member toward the base surface.

22. The edger assembly as recited in claim 21 wherein the support has a retainer surface spaced vertically from the block, the biasing member has a first end contactable with the block and a second end contactable with the retainer surface, such that when the rod is rotated while the edger contact surface is disposed against the base surface, the biasing member compresses and pushes against the block so as to bias the edger member against the base surface.

23. The edger assembly as recited in claim 21 wherein the support further has a generally flat vertical slide surface and the block has a generally flat outer surface section disposed against the slide surface such that the slide surface prevents rotation of the block when the rod rotates within the block threaded opening.

24. The edger assembly as recited in claim 23 wherein the support further has a generally horizontal surface section and an opening through the surface section, the block being disposeable against the support surface and the rod being displaceable through the block opening and the support surface opening.

25. The edger assembly as recited in claim 21 wherein the biasing member has a central opening and the rod extends completely through the central opening such that the rod prevents buckling of the biasing member when the member is compressed.

26. The edger assembly as recited in claim 21 wherein the block is a first block, the rod is a first rotatable rod, and the edger assembly further comprises a second block, the second block being coupled with the support, spaced horizontally from the first block and having a threaded opening, and a second rotatable rod having an upper end coupled with the edger plate and a lower end threadably engaged with the second threaded opening such that rotation of the second rod vertically displaces the second rod through the second opening to vertically displace the edger plate with respect to the support.

27. An edger assembly for a screed of a paving vehicle used to form a mat of paving material upon a base surface, the edger assembly comprising:

a support substantially immovably connectable with the screed assembly and having a threaded opening;

an edger plate having upper and lower ends, the lower end having a contact surface disposeable against the base surface; and a rotatable rod having an upper end coupled with the edger plate and a lower end coupled with the support such that the rod extends generally vertically upwardly from the support toward the edger plate upper end, the lower end being threadably engaged with the threaded opening such that rotation of the rod vertically displaces the rod through the opening to vertically displace the edger plate with respect to the base surface and with respect to the support.

28. An edger assembly for a screed of a paving vehicle used to form a mat of paving material upon a base surface, the edger assembly comprising:

a support substantially immovably connectable with the screed assembly;

an edger member having upper and lower ends, the lower end having a contact surface disposeable against the base surface;

an actuator having a lower end connected with the support and an upper end connected with the edger plate such that the actuator extends generally vertically upwardly from the support toward the edger member upper end, the actuator being configured to vertically displace the edger plate with respect to the support; and a biasing member having a first end contacting the support and a second end contacting the actuator and configured to bias the actuator downwardly toward the base surface such that the edger member contact surface pushes against the base surface.

29. An edger assembly for a screed assembly of a paving vehicle for forming a mat of paving material upon the base surface, the edger assembly comprising:

a support substantially immovably connectable with the screed assembly;

an edger plate movably connected with the support and having upper and lower ends, the lower end having a working surface contactable with the base surface;

an actuator having a first, lower portion connected with the support and a second, upper portion connected with the edger plate such that the actuator extends generally vertically upwardly from the support toward the edger member upper end, the actuator second portion being displaceable with respect to the first portion so as to vertically displace the edger plate with respect to the support; and a compressible member having a first end contacting the actuator first portion and a second end contacting the support such that displacement of the actuator second portion in a direction generally toward the base surface compresses the member so that the member pushes against the actuator in a direction generally toward the base surface.

30. An edger assembly for a screed of a paving vehicle used to form a mat of paving material upon a base surface, the edger assembly comprising:

a support connectable with the screed and including a threaded opening;

an edger member having upper and lower ends, the lower end having a contact surface contactable with the base surface; and an actuator having an upper end coupled with the edger member and a lower end coupled with the support such that the actuator extends generally vertically upwardly from the support toward the edger member upper end, the upper end being displaceable with respect to the lower end so as to vertically displace the edger member with respect to the base surface, the actuator including a rotatable rod having a first end coupled with the edger member and a second end threadably engaged with the support opening such that rotation of the rod vertically displaces the rod with respect to the support so as to vertically displace the edger member with respect to the base surface.

* * * * *